US012698584B2

(12) United States Patent
Lee et al.

(10) Patent No.: US 12,698,584 B2
(45) Date of Patent: Aug. 4, 2026

(54) LAUNDRY TREATMENT APPARATUS AND CONTROL METHOD FOR LAUNDRY TREATMENT APPARATUS

(71) Applicant: LG Electronics Inc., Seoul (KR)

(72) Inventors: Byungjin Lee, Seoul (KR); Manseok Lee, Seoul (KR); Ingeun Ahn, Seoul (KR)

(73) Assignee: LG Electronics Inc., Seoul (KR)

( * ) Notice: Subject to any disclaimer, the term of this patent is extended or adjusted under 35 U.S.C. 154(b) by 235 days.

(21) Appl. No.: 18/574,615

(22) PCT Filed: Jun. 21, 2022

(86) PCT No.: PCT/KR2022/008748
§ 371 (c)(1),
(2) Date: Dec. 27, 2023

(87) PCT Pub. No.: WO2023/003185
PCT Pub. Date: Jan. 26, 2023

(65) Prior Publication Data

US 2024/0183101 A1 Jun. 6, 2024

(30) Foreign Application Priority Data

Jul. 21, 2021 (KR) ..... 10-2021-0095710

(51) Int. Cl.
*D06F 58/44* (2020.01)
*D06F 33/32* (2020.01)
(Continued)

(52) U.S. Cl.
CPC ..... *D06F 58/44* (2020.02); *D06F 33/32* (2020.02); *D06F 34/14* (2020.02); *D06F 39/40* (2024.01);
(Continued)

(58) Field of Classification Search
None
See application file for complete search history.

(56) References Cited

U.S. PATENT DOCUMENTS

2006/0277690 A1 12/2006 Pyo et al.
2008/0141734 A1 6/2008 Son et al.
(Continued)

FOREIGN PATENT DOCUMENTS

JP 2014-150859 8/2014
KR 10-2008-0107767 12/2008
(Continued)

OTHER PUBLICATIONS

International Search Report and Written Opinion in International Appln. No. PCT/KR2022/008748, mailed on Sep. 30, 2022, 20 pages (with partial English translation).
(Continued)

*Primary Examiner* — Cristi J Tate-Sims
(74) *Attorney, Agent, or Firm* — Fish & Richardson P.C.

(57) ABSTRACT

A laundry treatment apparatus includes a drum, a steam generator, a steam flow path to the drum, a water supply pump, a water supply tank, a connection pipe which connects the steam generator to the water supply pump, a water level sensor which senses a water level inside the steam generator, a water supply pipe which connects the steam generator to a water supply source, and a water supply valve for opening and closing the water supply pipe. A control method for the laundry treatment apparatus includes operating the water supply pump for a preset first reference time period, sensing the water level inside the steam generator while operating the water supply pump, and setting the water supply through the water supply tank to a default water supply mode when the water level inside the steam generator is changed while operating the water supply pump.

11 Claims, 8 Drawing Sheets

(51) Int. Cl.

| | |
|---|---|
| ***D06F 34/14*** | (2020.01) |
| ***D06F 39/40*** | (2024.01) |
| ***D06F 58/20*** | (2006.01) |
| *D06F 101/00* | (2020.01) |
| *D06F 103/62* | (2020.01) |
| *D06F 105/02* | (2020.01) |
| *D06F 105/40* | (2020.01) |

(52) U.S. Cl.
CPC ..... *D06F 58/203* (2013.01); *D06F 2101/00* (2020.02); *D06F 2103/62* (2020.02); *D06F 2105/02* (2020.02); *D06F 2105/40* (2020.02)

(56) References Cited

U.S. PATENT DOCUMENTS

| | | | | |
|---|---|---|---|---|
| 2008/0148494 | A1* | 6/2008 | Son | D06F 58/44 137/1 |
| 2008/0302138 | A1* | 12/2008 | Bae | D06F 33/30 68/5 R |

FOREIGN PATENT DOCUMENTS

| | | |
|---|---|---|
| KR | 10-2008-0107787 A | 12/2008 |
| KR | 10-2017-0130569 | 11/2017 |
| KR | 10-2254901 | 5/2021 |
| WO | WO 2008/101611 | 8/2008 |

OTHER PUBLICATIONS

Extended European Search Report in European Appln. No. 22846057.2, mailed on May 26, 2025, 7 pages.

* cited by examiner

LAUNDRY TREATMENT APPARATUS AND CONTROL METHOD FOR LAUNDRY TREATMENT APPARATUS

CROSS-REFERENCE TO RELATED APPLICATIONS

This application is a National Stage application under 35 U.S.C. § 371 of International Application No. PCT/KR2022/008748, filed on Jun. 21, 2022, which claims the benefit of Korean Application No. 10-2021-0095710, filed on Jul. 21, 2021. The disclosures of the prior applications are incorporated by reference in their entirety.

TECHNICAL FIELD

The present disclosure relates to an apparatus for treating laundry and method for controlling the same.

BACKGROUND ART

A laundry treatment device is a general term for a washing machine for washing laundry (e.g., a washing object or a drying object), a dryer for drying laundry, and a device capable of performing both washing and drying of laundry.

A washing machine is generally provided to include a tub having water stored therein, a washing drum provided inside the tub to store laundry therein, a drive unit (i.e., a washing drive unit) rotating the washing drum, and a dryer is generally provided to include a drying drum having laundry stored therein, a drive unit (i.e., a drying drive unit) rotating the drying drum, and a heat exchange unit removing water from the laundry by supplying air to the drying drum.

The washing drive unit is generally provided to include a stator fixed to the tub to form a rotating magnetic field, a rotor rotated by the rotating magnetic field, and a rotating shaft connecting the washing drum and the rotor through the tub, while the drying drive unit is generally provided to include a motor, a pulley fixed to a rotating shaft of the motor, and a belt (i.e., a power transmission unit) connecting a rotational motion of the pulley to the drying drum.

The washing drive unit is provided such that the rotating shaft of the motor connects the washing drum and the rotor together. For washing or dehydration of laundry, the washing drive unit needs to control an RPM of the washing drum high or change a rotation direction of the washing drum. If the motor's rotating shaft is provided to directly connect the washing drum and the rotor, there is an effect that the RPM and rotation direction of the washing drum can be easily controlled.

On the other hand, the drying drive unit of the related art generally has a structure in which the power transmission unit such as the belt or the like connects the drying drum and the rotating shaft of the motor. Since the dryer barely needs to maintain a high RPM of the drying drum or change the rotation direction of the drying drum, there is no problem in rotating the drying drum through the power transmission unit such as the belt or the like. However, if it is possible to change the RPM and rotation direction of the drying drum, the movement of the laundry inside the drying drum may be controlled, and thus the dryer may be also expected to shorten the drying time and improve drying performance.

Among the washing machines of the related art, there is a washing machine equipped with a drive unit (a decelerator and a motor) that decelerates an RPM of a rotor and delivers it to a drum (Publication No. 10-2004-0071426). In the related art washing machine equipped with the decelerator and the motor, a stator of the motor and the decelerator are fixed to a tub, respectively. In other words, the stator provided in the washing machine of the related art has the structure of being fixed to the tub instead of being directly fixed to the decelerator (i.e., a structure in which a vibrating amplitude of the stator may differ from that of the decelerator). The drive unit of the aforementioned structure has difficulty in maintaining the concentricity of an input shaft connected to the rotor and an output shaft connected to the drum when the tub and drum vibrate and keeping a gap between the stator and the rotor.

On the other hand, among the laundry treatment devices of the related art, there is a laundry treatment device equipped with a steam generator that supplies steam into a drum. The steam generator provided in the laundry treatment device of the related art is provided to be supplied with water through a water supply tank detachably provided in the laundry treatment device or a water supply source (water pipe) provided in a space where the laundry treatment device is installed.

DISCLOSURE

Technical Tasks

One technical task of the present disclosure is to provide an apparatus for treating laundry and method of controlling the same, which may have a steam generator configured to be supplied with water through a water supply tank or directly from a water supply source such as a water supply facility, etc.

Another technical task of the present disclosure is to provide an apparatus for treating laundry and method of controlling the same, which is capable of self-determining whether water is supplied to a steam generator through a water supply tank or a water supply source.

Further technical task of the present disclosure is to provide an apparatus for treating laundry and method of controlling the same, which is capable of self-changing a preset water supply system.

Another further technical task of the present disclosure is to provide an apparatus for treating laundry and method of controlling the same, which is configured to decelerate and transfer a rotation speed of a rotor to a drum, thereby being advantageous in maintaining the concentricity between a rotation center of the rotor and a rotation center of the drum.

Technical Solutions

The present application provides a method of controlling a laundry treating apparatus having a laundry receiving unit providing a space for receiving laundry therein, a steam generator generating steam, a steam passage supplying the steam discharged from the steam generator to the laundry receiving unit, a water supply tank detachably coupled to a water supply pump, a connection pipe connecting the steam generator and the water supply pump, a water level sensor sensing a water level inside the steam generator, a water supply pipe connecting the steam generator and a water supply source, and a water supply valve opening/closing the water supply pipe.

The method may include a pump controlling step of operating the water supply pump, a first water level sensing step of sensing the water level inside the steam generator by the water level sensor in the course of the pump controlling step, and a water supply mode setting step of setting a water supply by the water supply tank based on a default water supply mode based on that the water level inside the steam generator is changed in the course of the pump controlling step.

The method may further include a valve controlling step of opening the water supply pipe by controlling the water supply valve based on that the water level inside the steam generator is not changed in the course of the pump controlling step and a second water level sensing step of sensing the water level inside the steam generator by the water level sensor in the course of the valve controlling step.

Based on that the water level inside the steam generator is changed in the course of the valve controlling step, the water supply mode setting step may set the water supply by the water supply source based on the default water supply mode.

The pump controlling step may be terminated based on that the water level inside the steam generator reaches a preset reference water level or an operation time of the water supply pump reaches a preset first reference time.

The first reference time may be set based on a time when the water level inside the steam generator empty due to operation of the water supply pump reaches a highest level the water level sensor is able to sense.

The valve controlling step may be terminated based on that the water level inside the steam generator reaches the reference water level or an operation time of the water supply valve reaches a preset second reference time.

The second reference time may be set based on a time when the water level inside the steam generator empty due to operation of the water supply valve reaches a highest level the water level sensor is able to sense.

The reference water level may be set based on a highest level the water level sensor is able to sense.

The method may further include a receiving step of receiving a control command for requesting setting of a water supply mode through an input unit configured to receive an input of a control command from a user, and the pump controlling step, the first water level sensing step, the valve controlling step, the second water level sensing step, and the water supply mode setting step may be executed after completion of the receiving step.

The method may further include an initial water level sensing step of sensing the water level inside the steam generator by the water level sensor before initiation of the pump controlling step after completion of the receiving step, and the pump controlling step, the first water level sensing step, the valve controlling step, the second water level sensing step, and the water supply mode setting step may be executed based on that the water level measured in the initial water level sensing step is less than the reference water level.

Provided is a method of controlling a laundry treating apparatus having a laundry receiving unit providing a space for receiving laundry therein, a steam generator generating steam, a steam passage connecting the steam generator and the laundry receiving unit, a water supply pipe connecting the steam generator and a water supply source, a water supply valve opening and closing the water supply pipe, a water supply pump, a water supply tank storing water and detachably coupled to the water supply pump, a connection pipe connecting the steam generator and the water supply pump, and a water level sensor sensing a water level inside the steam generator, the method including a valve controlling step of operating the water supply valve for a preset valve control reference time and a water supply mode setting step of setting a water supply by the water supply source based on a default water supply mode based on that the water level inside the steam generator is changed in the course of the valve controlling step.

The method may further include a pump controlling step of operating the water supply pump for a preset pump control reference time based on that the water level inside the steam generator is not changed during the valve controlling step, and based on that the water level inside the steam generator is changed in the course of the valve controlling step, the water supply mode setting step may set the water supply by the water supply source based on the default water supply mode.

Advantageous Effects

The present application provides an apparatus for treating laundry and method of controlling the same, which may have a steam generator configured to be supplied with water through a water supply tank or directly from a water supply source such as a water supply facility, etc.

In addition, the present application provides an apparatus for treating laundry and method of controlling the same, which is capable of self-determining whether water is supplied to a steam generator through a water supply tank or a water supply source.

In addition, the present application provides an apparatus for treating laundry and method of controlling the same, which is capable of self-changing a preset water supply system.

In addition, the present application provides an apparatus for treating laundry and method of controlling the same, which is configured to decelerate and transfer a rotation speed of a rotor to a drum, thereby being advantageous in maintaining the concentricity between a rotation center of the rotor and a rotation center of the drum.

BEST MODE

Hereinafter, an embodiment of a laundry treating apparatus will be described in detail with reference to the accompanying drawings.

Figure 1:
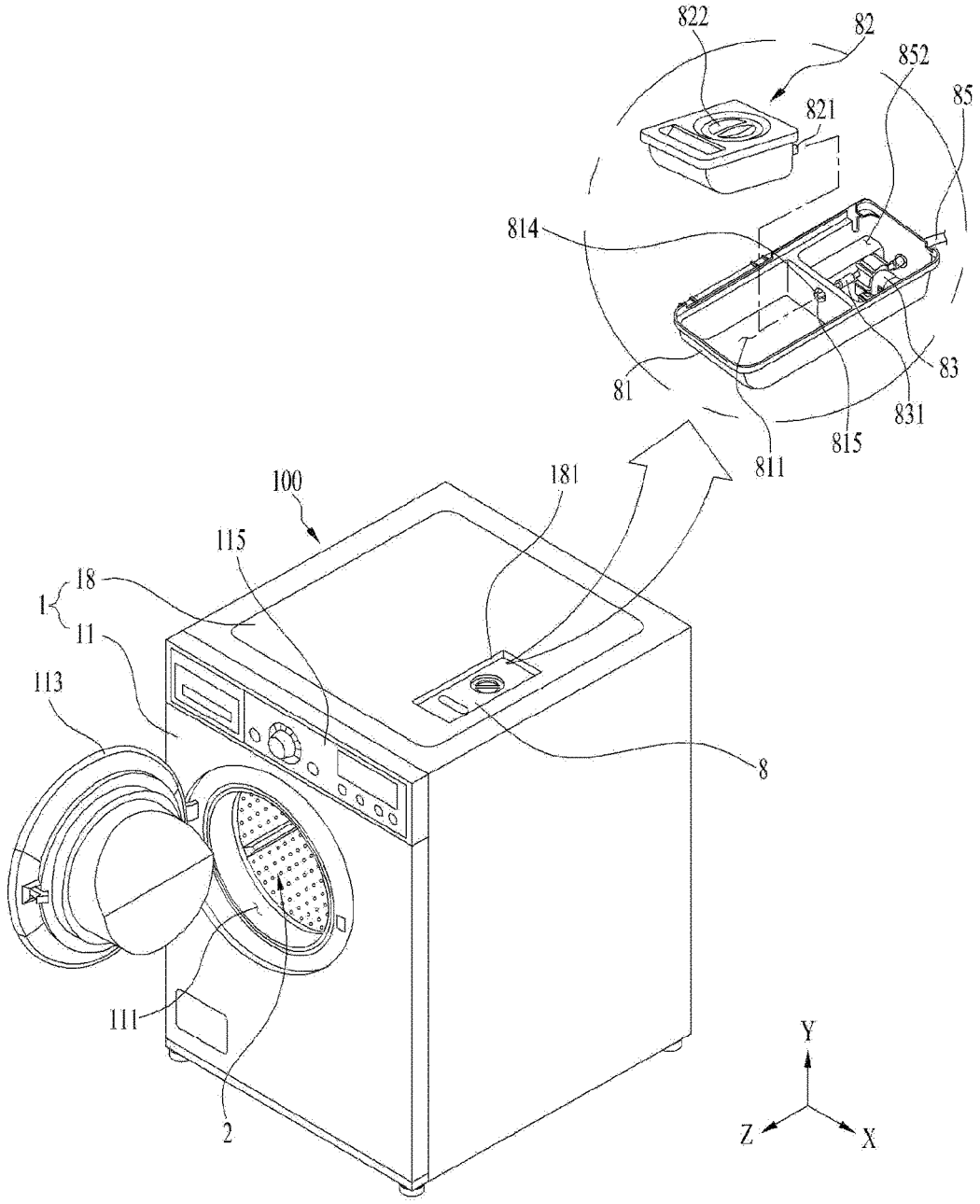
FIG. 1 and FIG. 2 illustrate an example of a laundry treating apparatus.

FIG. 1 illustrates an example of a laundry treating apparatus 100. The laundry treating apparatus 100 may include a cabinet 1 and a laundry receiving unit 2 rotatably provided in the cabinet to provide a space in which laundry (e.g., washing objects or drying objects to be dried) are stored.

Figure 2:
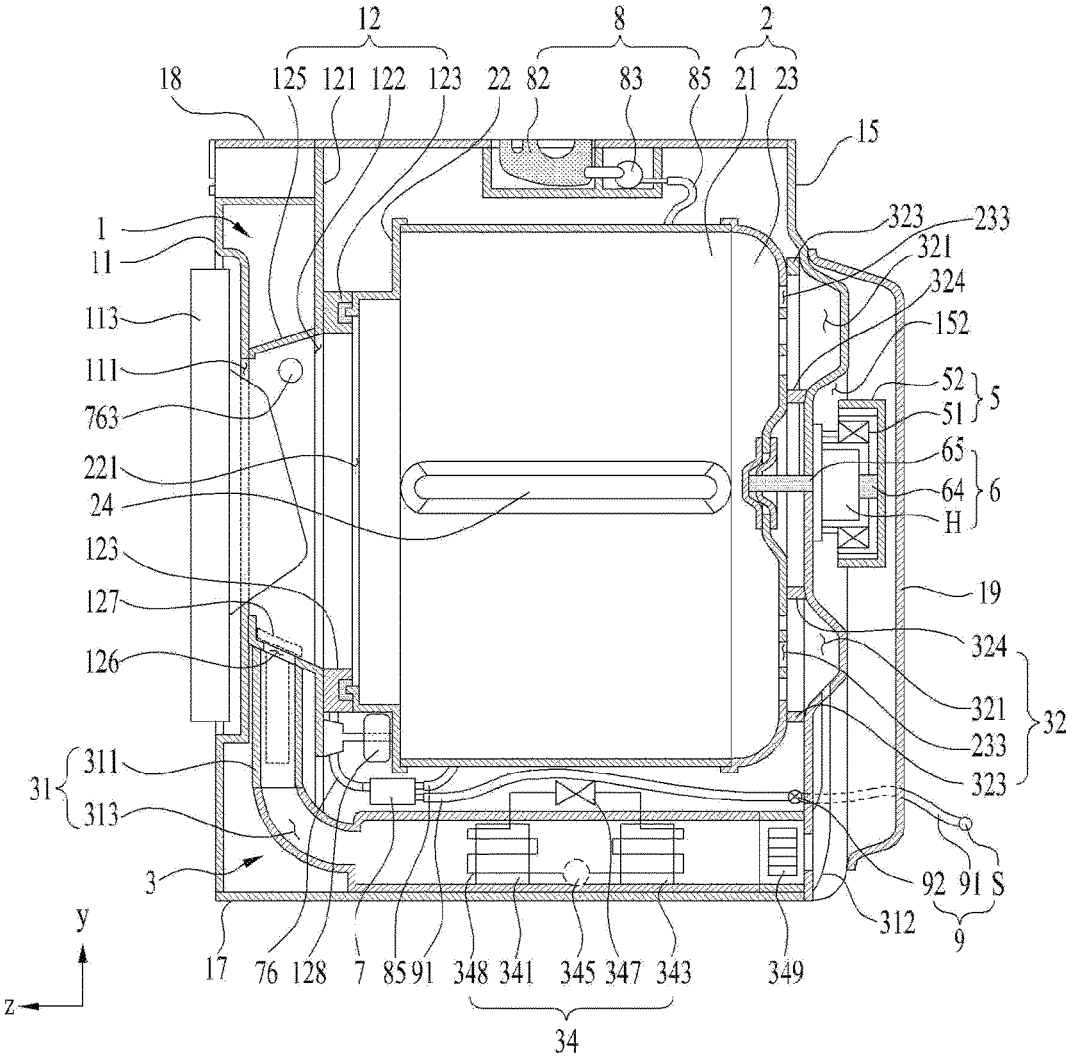

As shown in FIG. 2, the cabinet 1 may be provided with a drying unit 3 for removing moisture or water from laundry by supplying high-temperature dry air (e.g., air having a higher temperature than a room temperature, air having a dryness degree higher than that of than indoor air) to the laundry receiving unit 2.

As shown in FIG. 1, the cabinet 1 may include a front panel 11 forming a front surface of the laundry treating apparatus, a base panel 17 forming a bottom surface of the laundry treating apparatus, and a cover panel 18 forming an upper surface of the laundry treating apparatus.

The front panel 11 is provided with an entrance 111 communicating with the laundry receiving unit 2, and the entrance 111 may be configured to be closed by a door 113. The front panel 11 may be provided with a control panel 115, and the control panel 115 may include an input unit for receiving a control command from a user and a display unit for outputting information such as a control command or the like selectable by the user.

The input unit may include a power supply request unit for requesting power supply to the laundry treating apparatus, a course input unit for enabling a user to select a desired course among a plurality of courses, and an execution request unit for requesting initiation of the course selected by the user. The display unit may be provided as a display panel on which characters or symbols are displayed, a speaker for outputting a sound signal, and the like.

When the laundry treating apparatus 100 is provided as a dryer for drying laundry, the laundry receiving unit 2 may be provided as a drum. Instead, when the laundry treating apparatus 100 is provided as a washing machine for washing laundry, the laundry receiving unit 2 may include a tub provided in the cabinet 1 to store water and a drum rotatably provided in the tub to store laundry. FIG. 2 illustrates an example of a case that the laundry receiving unit 2 is provided with only a drum.

The drum 2 may have a hollow cylindrical shape. That is, the drum 2 may include a cylindrical drum body 21 having an open front surface and an open rear surface, a front cover 22 forming a front surface of the drum body 21, and a rear cover 23 forming a rear surface of the drum body 21.

The front cover 22 may be provided with a drum entrance 221 enabling the inside of the drum body 21 to communicate with the outside, and the rear cover 23 may be provided with an air inlet 233 for introducing external air into the drum body 21.

The drum body 21 may further include a lifter 24. The lifter 24 is a means for allowing the laundry to repeatedly ascend and fall in the drum. The lifter 24 may be provided in a manner that a board extending from the front cover 22 toward the rear cover 23 protrudes from the drum body 21 toward the center of rotation of the drum 2 (e.g., protruding from a circumferential surface of the drum toward the center of rotation of the drum).

When the laundry treating apparatus 100 is provided as a device for drying laundry only, the drum 2 may not have a drum through-hole provided to perforate the drum body 21 to enable the inside of the drum to communicate with the outside of the drum.

The drum 2 may be rotatably fixed to at least one of a first body support portion 12 and a second body support portion 15. FIG. 2 illustrates an example of a case that the rear cover 23 is rotatably fixed to the second body support portion 15 through a power transmission unit 6, which will be described later, and the front cover 22 is rotatably connected to the first body support portion 12.

The first body support 12 may include a support panel 121 positioned between the front panel 11 and the front cover 22 in a manner of being fixed to the cabinet 1. The support panel 121 may be fixed to the base panel 17 so as to be positioned between the front panel 11 and the front cover 22.

The support panel 121 may include a support panel through-hole 122, a drum connection body 123 connecting the support panel through-hole 122 to the drum entrance 221, and a panel connection body 125 connecting the support panel through-hole 122 and the entrance 111 together. The support panel through-hole 122 is provided to perforate the support panel 121 to allow the entrance 111 and the drum entrance 221 to communicate with each other.

The drum connection body 123 may be provided as a pipe fixed to a rear surface of the support panel 121 (i.e., a surface facing the drum entrance in the space provided by the support panel). One end of the drum connection body 123 may be provided to surround the support panel through-hole 122, and a free end of the drum connection body 123 may be provided to support the front cover 22. That is, the free end of the drum connection body 123 may be inserted into the drum entrance 221, or may be provided to be in contact with a free end (i.e., an edge of the drum entrance) of the front cover 22 forming the drum entrance 221.

The panel connection body 125 may be provided as a pipe fixed to the front surface of the support panel 121 (i.e., a surface facing the front panel in the space provided by the support panel). One end of the panel connection body 125 may be provided to surround the support panel through-hole 122, and the other end of the panel connection body 125 may be provided to be connected to the entrance 111. Accordingly, the laundry supplied through the entrance 111 may move to the drum body 21 through the panel connection body 125, the support panel through-hole 122, the drum connection body 123, and the drum entrance 221.

An exhaust port 126 for discharging the air inside the drum 2 to the outside of the drum may be provided in the support panel 121, and a filter 127 may be detachably fixed to the exhaust port 126. The filter 127 may be provided as any structure capable of filtering foreign substances from the air moving from the drum 2 to the exhaust port 126.

A drum support portion 128 may be further provided to the support panel 121 to prevent the drum 2 from sagging. The drum support may be provided as a roller that is fixed to the support panel 121 and rotatably supports the drum 2.

Figure 3:
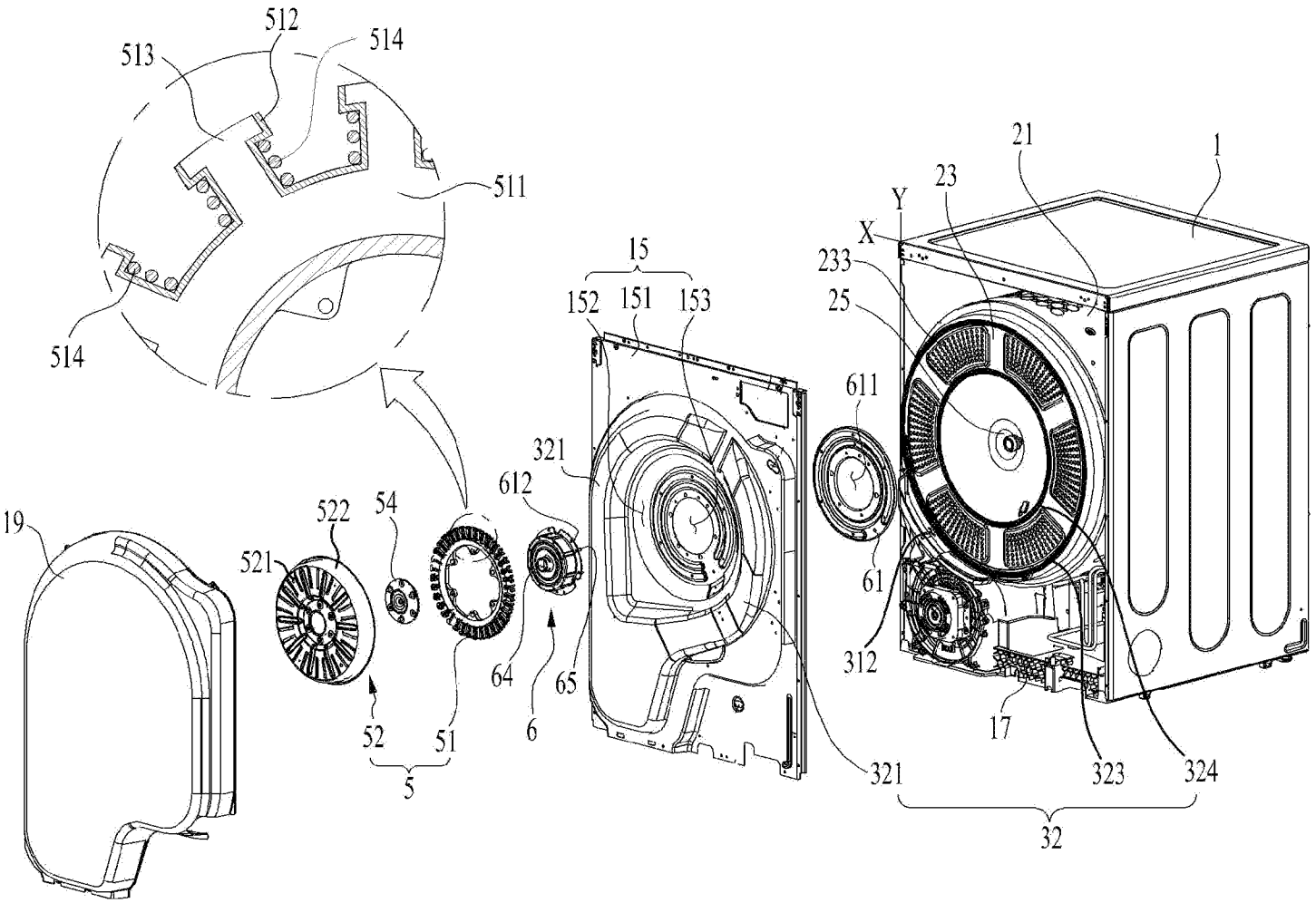
FIG. 3 illustrates an example of a drying unit provided in a laundry treating apparatus.

The second body support portion 15 may be provided as a fixed panel 151 fixed to the cabinet 1 to be positioned at a point spaced apart from the rear cover 23. FIG. 3 illustrates an example of a case that the fixed panel 151 is fixed to the base panel 17 to form the rear surface (i.e., the rear surface of the cabinet) of the laundry treating apparatus 100.

The fixed panel 151 may be provided with a drive unit mounting recess 152 for providing a space in which the motor 5 is mounted. The drive unit mounting recess 152 may be provided as a recess formed in a manner that the fixed panel 151 is concavely bent toward the rear cover 23 of the drum. The fixed panel 151 is provided with a fixed panel through-hole 153 through which a shaft (i.e., an output shaft) for rotating the drum 2 passes, and the fixed panel through-hole 153 may be positioned inside the drive unit mounting recess 152.

As described above, when the drum 2 is provided with the drum body 21, the front cover 22 fixed to the drum body, and the rear cover 23 fixed to the drum body, the rigidity of the drum is increased compared to the structure in which the open front and rear surfaces of the drum body 21 are rotatably connected to the support panel 121 and the fixed panel 151, respectively. When the rigidity of the drum is increased, deformation of the drum body 21 during rotation of the drum may be minimized, and this may minimize a problem in which laundry is caught in a space between the drum body and the support panel or a space between the drum body and the fixed panel when the drum body 21 is deformed (i.e., minimizing the load of the motor).

As shown in FIG. 2, the drying unit 3 may include an exhaust passage 31 connected to the exhaust port 126, a supply passage 32 guiding the air supplied from the exhaust passage 31 to the drum body 21, and a heat exchange unit 34 provided in the exhaust passage 31 to sequentially perform dehumidification and heating of air.

The exhaust passage 31 may include a first duct 311 connected to the exhaust port 126, a second duct 312 connected to the supply passage 32, and a third duct 313 connecting the first duct 311 and the second duct 312. The third duct 313 may be fixed to the base panel 17.

The heat exchange unit 34 may be provided as various devices capable of sequentially performing dehumidification and heating of the air introduced into the exhaust passage 31, and FIG. 2 illustrates an example of a case that the heat exchange unit 34 is provided as a heat pump. That is, the heat exchange unit 34 includes a first heat exchanger (i.e., a heat absorption part) 341 for removing moisture or water from the air introduced into the exhaust passage 31, a second heat exchanger (i.e., a heating part) 343 provided inside the exhaust passage 31 to heat the air having passed through the heat absorption part 341, and a fan 349 for allowing the air discharged from the drum 2 to sequentially pass through the heat absorption part and the heating part and move to the supply duct 32.

The heat absorption part 341 and the heating part 343 are sequentially disposed along a moving direction of air and are connected to each other through a refrigerant pipe 348 forming a circulation passage of a refrigerant. The refrigerant moves along the refrigerant pipe 348 by a compressor 345 located outside the exhaust passage 31, and the refrigerant pipe 348 is provided with a pressure regulator 347 for adjusting the pressure of the refrigerant.

As shown in FIG. 3, the air inlet 233 provided in the rear cover 23 of the drum may be provided by disposing a plurality of holes so as to surround the center of the rear cover 23 (e.g., the center of rotation of the drum). In this case, the supply passage 32 includes a supply duct 321 provided in the fixed panel 151 to form a movement path of air discharged from the second duct 312 and first and second passage forming portions 323 and 324 configured to guide air inside the supply duct 321 to the air inlet 233.

The supply duct 321 may be provided to form a passage (i.e., a moving path of air) by bending the fixed panel 151 in a direction away from the rear cover 23. In addition, the supply duct 321 may be provided in a ring shape surrounding the drive unit mounting recess 152, and a discharge port of the second duct 312 may be connected to the supply duct 321.

The first passage forming portion 323 may be provided to surround an outer circumferential surface of a ring formed by the air inlets 233 (i.e., a circumferential surface having a longer diameter of two circumferential surfaces of the ring), and the second passage forming portion 324 may be provided to surround an inner circumferential surface of the ring formed by the air inlets 233 (i.e., a circumferential surface having a shorter diameter of the two circumferential surfaces of the ring).

The first passage forming portion 323 and the second passage forming portion 324 may be fixed to the rear cover 23 or may be fixed to the supply duct 321, and FIG. 3 illustrates an example of a case that the passage forming portions 323 and 324 are fixed to the rear cover 23. In this case, a free end of the first passage forming portion 323 surrounds an outer circumferential surface of the passage (i.e., a ring-shaped passage) formed by the supply duct 321, and a free end of the second passage forming portion 324 is provided to surround an inner circumferential surface of the passage formed by the supply duct 321. The first passage forming portion 323 and the second passage forming portion 324 may be provided as rubber, felt, etc.

A motor 5 for generating power required for rotation of the drum 2 is provided to include a stator 51 positioned in the drive unit mounting recess 152 to form a rotating field and a rotor 52 rotated by the rotating field. A rotational movement of the rotor 52 is transmitted to the drum 2 through a power transmission unit 6 fixed to the fixed panel 151, and the stator 51 is fixed to at least one of the fixed panel 151 and the power transmission unit 6.

When the stator 51 is fixed to the power transmission unit 6, there is an advantageous effect in maintaining the coaxiality between the input shaft 64 and the output shaft 65 provided in the power transmission unit 6 (it is possible to minimize the vibration of the laundry treating apparatus during rotation of the drum and to minimize the degradation of durability of the power transmission unit).

In order to prevent the motor 5 located in the drive unit mounting recess 152 from being exposed externally (for motor durability enhancement and safety accident prevention by preventing the motor from being exposed to an external environment), a drive unit cover 19 may be further provided to the fixed panel 151 to prevent the motor 5 from being exposed to the outside. Further, the drive unit cover 19 may be provided in a shape capable of preventing the supply duct 321 from being exposed to the outside (e.g., a shape of surrounding the supply duct). This is to prevent heat from being discharged out of the supply duct 321 and to prevent safety accidents that may occur when a human body touches the supply duct 321.

The stator 51 includes a ring-shaped core 511 having a through-hole (i.e., a core through-hole) at a center thereof, a multitude of support bars 513 radially protruding from an outer circumferential surface of the core 511, an insulator 512 insulating the core and the support bars, and a coil 514 provided to surround the support bars 513.

The rotor 52 may include a disk-shaped rotor body 521, a rotor circumferential surface 522 extending from an edge of the rotor body 521 toward the fixed panel 515 to form a space in which the stator 51 is received, and a multitude of permanent magnets 523 fixed to the rotor circumferential surface 522 so that N and S poles are alternately exposed.

Figure 4:
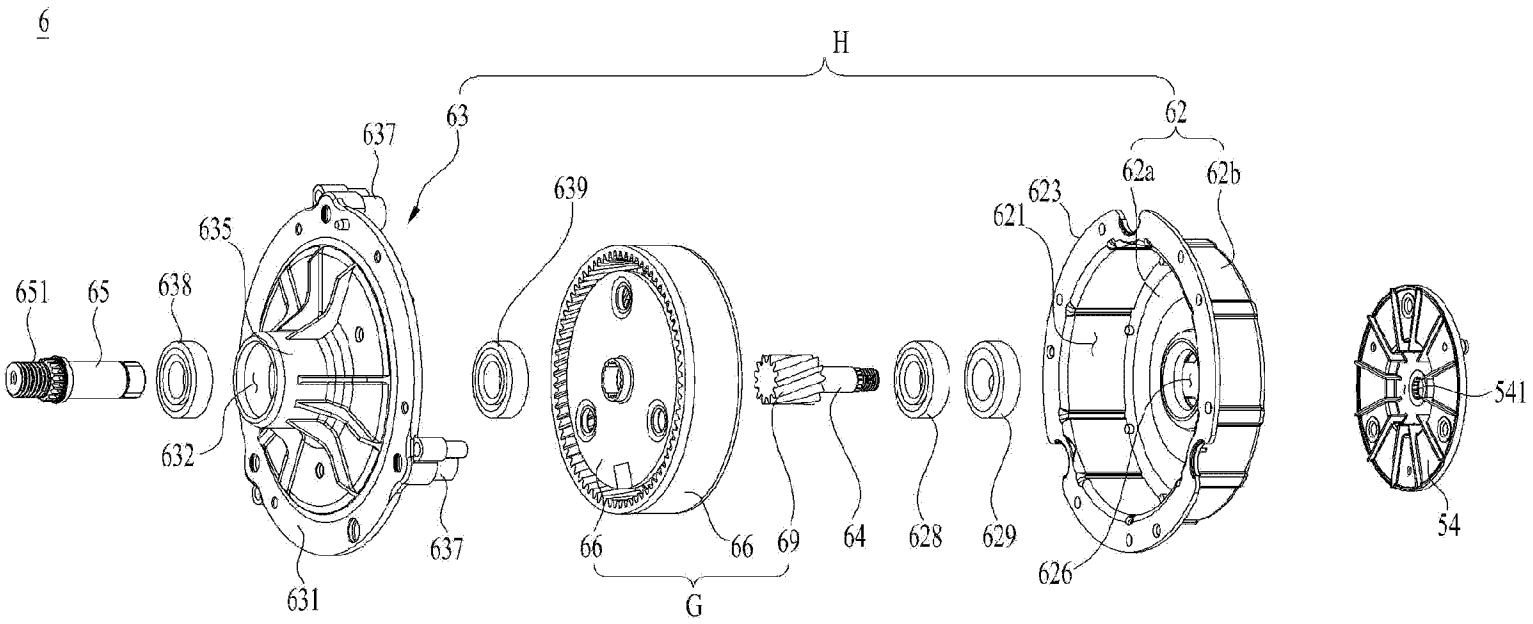
FIG. 4 and FIG. 5 illustrate an example of a power transmission unit.

FIG. 4 illustrates an example of a power transmission unit 6 connecting the rotor 52 and the rear cover 23 of the drum.

The power transmission unit 6 includes a housing H fixed to the fixed panel 151, an input shaft 64 rotatably fixed to a bottom surface (i.e., a surface facing a direction in which the rotor is positioned) of the housing H, an output shaft 65 rotatably fixed to an upper surface (i.e., a surface facing a direction in which the fixed panel is positioned) of the housing H, and a gear unit G disposed in the housing to transfer a rotational motion of the input shaft 64 to the output shaft 65.

The input shaft 64 may be provided as a shaft having one end fixed to the rotor 52 and the other end positioned inside the housing H, and the output shaft 65 may be provided as a shaft having one end fixed to the rear cover 23 and the other end positioned inside the housing H. The gear unit G is provided to connect one end of the input shaft 64 positioned inside the housing H and one end of the output shaft 65 positioned inside the housing.

Preferably, the housing H is fixed to the fixed panel 151 so as to be positioned in a space (i.e., an outer cabinet space) separated from a space (i.e., an inner cabinet space) in which the drum 2 is located. This is to improve the durability of the power transmission unit 6 by minimizing the transmission of heat (e.g., heat emitted from the drum or the drying unit) inside the cabinet to the inside of the housing H.

The input shaft 64 may be coupled to the rotor body 521 through a shaft fixing part 54. The shaft fixing part 54 may include a shaft fixing hole 543 to which one end of the input shaft 64 is fixed.

The output shaft 65 may be inserted into the fixed panel through-hole 153 to be connected to the rear cover 23, and the rear cover 23 may be provided with a shaft fastening part 25 to which the output shaft 65 is fixed. This is to disperse the stress applied to the center of the rear cover 23 during the rotation of the output shaft 65.

As shown in FIG. 3, the fixed panel 151 may further include a transmission unit bracket 61 to which the housing H is fixed. This is to increase the rigidity of the area to which the power transmission unit 6 is fixed. A bracket through-hole 611 through which the output shaft 65 passes may be provided in the transmission unit bracket 61.

As shown in FIG. 4, the housing H may include a housing body 62 having a hollow cylindrical shape and having an open hole on a surface facing the fixing body 151 and a housing cover 63 fixed to the housing body 62 to close the open hole.

The housing body 62 may be provided to form a receiving space 621 in which the gear unit G is mounted. The receiving space 621 may be provided to be formed through a housing base 62*a* to which the input shaft 64 is fixed and a housing circumferential surface 62*b* extending from an edge of the housing base 62*a* toward the housing cover 63.

Figure 5:
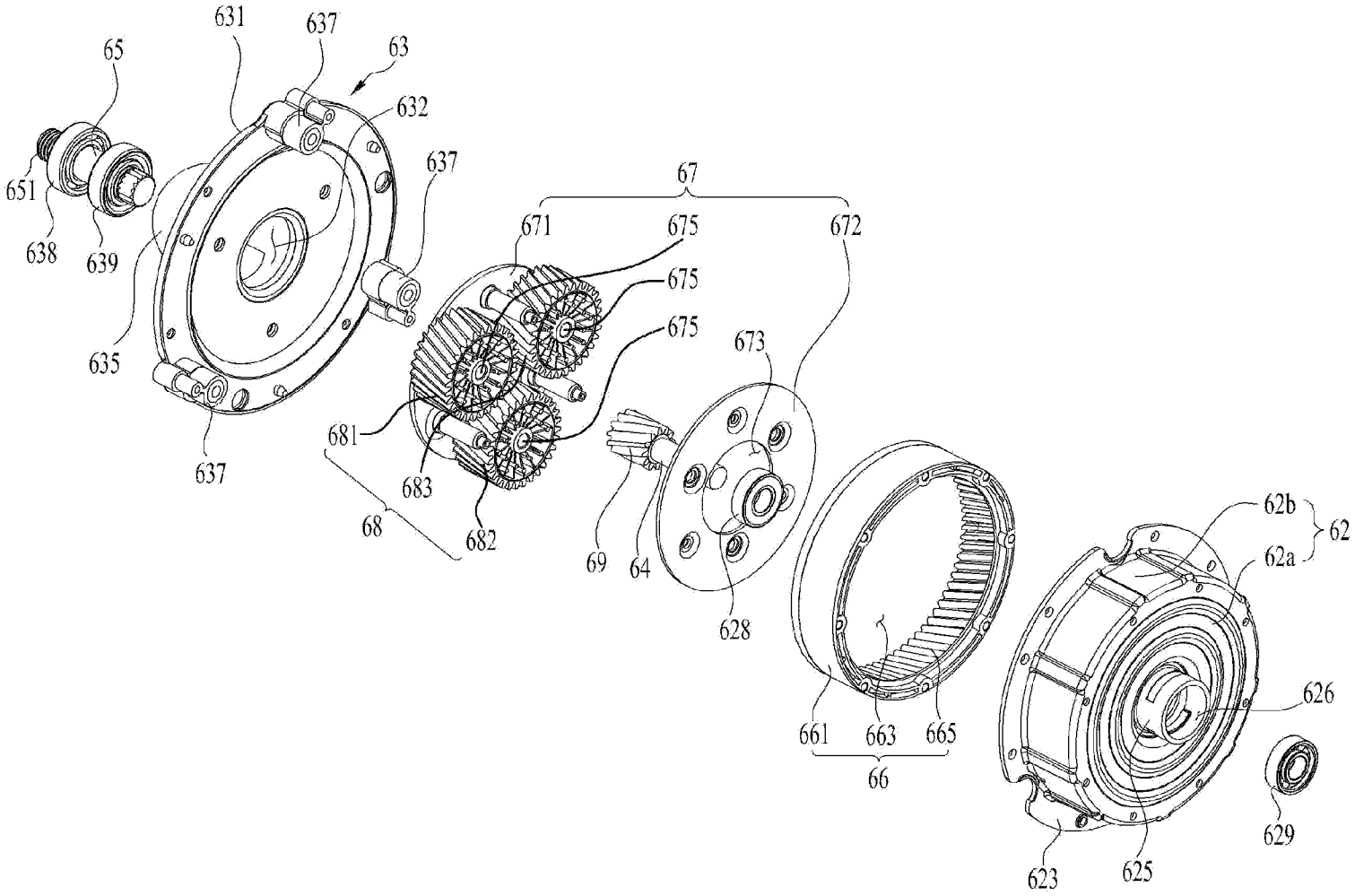

As shown in FIG. 5, the housing body 62 is provided with an input shaft support portion 625 extending from the housing base 62*a* toward the rotor 52, and the input shaft support portion 625 may be provided as a pipe surrounding an input shaft through-hole 626 passing through the housing body 62.

The input shaft 64 inserted into the input shaft through-hole 626 is rotatably fixed to the input shaft support portion 625 through input shaft bearings 628 and 629. The input shaft bearings may include a first input shaft bearing 628 fixed to the input shaft support portion 625 and a second input shaft bearing 629 fixed inside the input shaft through-hole 626 and positioned between the first input shaft bearing 628 and the rotor 52.

The housing cover 63 may be provided in any shape capable of opening or closing an opening hole provided in the housing body 62, and FIG. 5 illustrates an example of a case that the housing cover 63 is provided as a disk-shaped cover body 631. The housing cover 63 may be provided in a manner of being fixed to the housing body 62 through a cover fixing plate 623 provided to the housing circumferential surface 62*b*.

The housing cover 63 may include an output shaft through-hole 632 provided to pass through the cover body 631 and a pipe-shaped output shaft support portion 635 extending from the cover body 631 toward the fixed panel 151 and surrounding the output shaft through-hole 632.

The output shaft support portion 635 may include output shaft bearings 638 and 639 rotatably fixing the output shaft 65 to the output shaft through-hole 632.

The output shaft bearings may include a first output shaft bearing 638 and a second output shaft bearing 639 that are fixed to the output shaft support portion 635 and are positioned inside the output shaft through-hole 631.

The housing cover 63 is provided with a mounting portion 637 to which the stator 51 is fixed. A multitude of mounting portions 637 may be provided along a circumferential surface of the cover body 631, and the stator 51 may be fixed to the housing H through a bolt that connects the insulator 512 and the mounting portion 637.

As described above, the housing H is fixed to the fixed panel 151, the stator 51 is fixed to the housing H through the mounting portion 637, and the rotor 52 is fixed to the housing H through the input shaft 64. Since the stator 51 and the rotor 52 are fixed to the housing H (i.e., the stator and the rotor vibrate together with the housing), it is possible to minimize the degradation of the coaxiality between the input shaft 64 and the output shaft 65.

The gear unit G may include a ring gear 66 fixed to the housing circumferential surface 62*b* and positioned in the receiving space 621, a driving gear 69 fixed to the input shaft 64 and positioned inside the receiving space 621, a cage 67 positioned inside the receiving space 622 and having the other end of the output shaft 65 fixed thereto, and a driven gear 68 rotatably fixed to the cage 67 to connect the driving gear 69 and the ring gear 66.

The ring gear 66 may include a gear body 661 fixed to the housing circumferential surface 62*b*, a gear body through-hole 663 provided to pass through the gear body, and gear teeth 665 provided along an inner circumferential surface of the gear body.

The cage 67 may include a first base 671 positioned inside the gear body through-hole 663 and having one end of the output shaft 65 fixed thereto, a second base 672 positioned inside the gear body through-hole 663 and having a base through-hole 673 at the center thereof, and a connection shaft 675 connecting the first base and the second base and forming a rotary shaft of the driven gear 68. Since the output shaft 65 is fixed to the first base 671, whether the output shaft 65 is rotated is determined depending on whether the cage 67 is rotated.

The driven gear 68 may be provided as a multitude of gears rotatably fixed to the connection shaft 675, and the drawing illustrates a case in which the driven gear is provided as a first driven gear 681, a second driven gear 682, and a third driven gear 683.

The input shaft 64 is inserted into the base through-hole 673 to form a coaxial shaft with the output shaft 65, and gear teeth provided to the driving gear 69 are positioned in a space formed among the driven gears to be engaged with the gear teeth of the driven gears 682, 682, and 683.

In order to disperse the stress applied to the center of the rear cover 23 when the output shaft 65 rotates (i.e., to minimize the degradation of durability of the rear cover), the output shaft 65 is connected to the rear cover 23 of the drum through the shaft fastening part 25.

Figure 6:
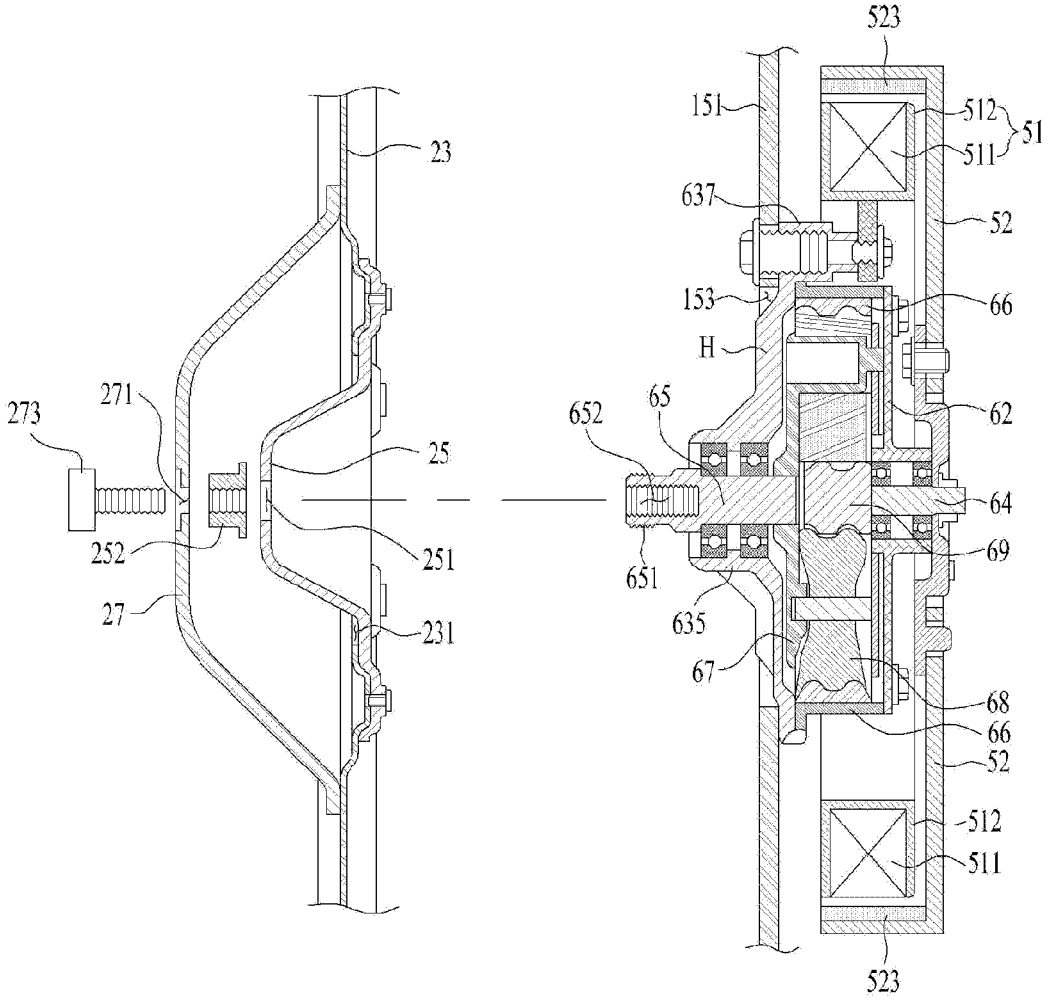
FIG. 6 illustrates an example of a fastening structure of an output shaft and a drum.

As shown in FIG. 6, the rear cover 23 may be provided with a rear cover through-hole 231, and the shaft fastening part 25 may be fixed to the rear cover 23 to close the rear cover through-hole 231.

The shaft fastening part 25 is provided with a fastening part through-hole 251 into which the output shaft 65 is inserted. The output shaft 65 inserted into the fastening part through-hole 251 may be fixed to the shaft fastening part 25 through a nut 252. To this end, a screw thread 651 should be provided on a circumferential surface of the output shaft.

In order to prevent the shaft fastening part 25 from being exposed to the inside of the drum 2, the laundry treating apparatus 100 may further include a fastening part cover 27. The fastening part cover 27 may be provided in any shape capable of closing the rear cover through-hole 231 and preventing exposure of the shaft fastening part 25.

As shown in FIG. 6, the fastening part cover 27 may be fixed to the output shaft 65 through a bolt 273. To this end, the fastening part cover 27 may be provided with a cover through-hole 271 into which the bolt 273 is inserted, and a fastening recess 652 to which the bolt is fastened may be provided at one end of the output shaft 65.

An operation process of the power transmission unit 6 described above is as follows. When the rotor 52 rotates, the input shaft 64 rotates. When the driving gear 69 is rotated by the input shaft 64, the driven gears 681, 682, and 683 engaged with the driving gear 69 also rotate. Since the driven gears 681, 682, and 683 are engaged with the ring gear 66 fixed to the housing body 62, the cage 67 and the output shaft 65 rotate when the driven gear 68 rotates, and the drum 2 fixed to the output shaft 65 may also rotate.

Figure 7:
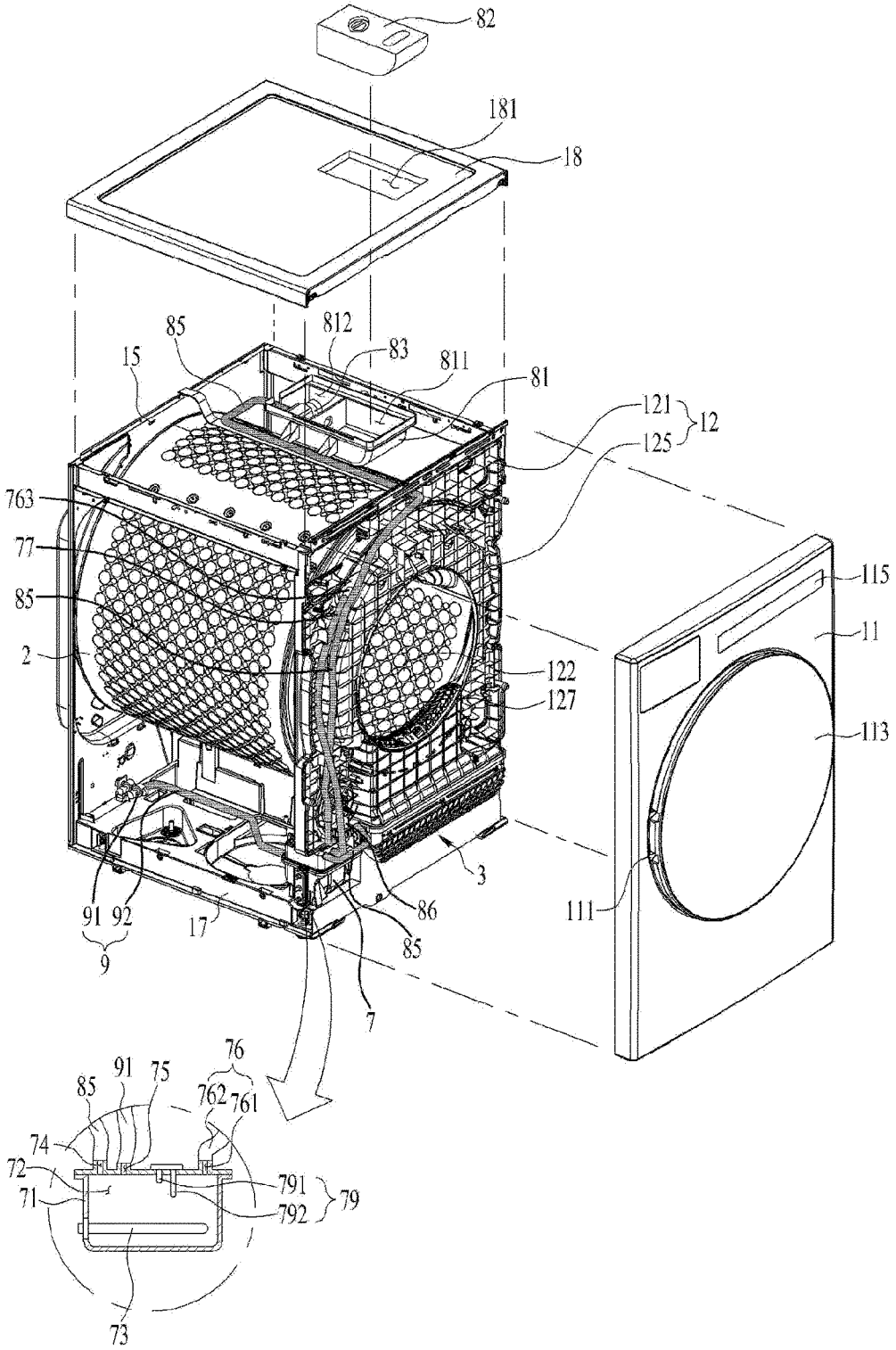
FIG. 7 illustrates an example of a steam generator and a water supply unit.

As shown in FIG. 7, the laundry treating apparatus 100 may further include a steam generator 7.

The steam generator 7 is a means for supplying steam to the drum 2, and may include a storage body 71 fixed inside the cabinet 1, a storage unit 72 provided in the storage body to store water, and a heater 73 for generating steam by heating water in the storage unit 72.

The steam generator 7 is supplied with water through a water supply unit 8 and 9, and FIG. 7 illustrates an example of a case that the water supply unit includes a first water supply unit 8 and a second water supply unit 9.

The first water supply unit 8 is a means for supplying water to the steam generator 7 through a water supply tank detachably provided in the laundry treating apparatus 100, and the second water supply unit 9 is a means for supplying water to the steam generator 7 through a water supply source (e.g., a water supply facility, etc.) provided in a space where the laundry treating apparatus is installed.

The second water supply unit 9 may include a water supply pipe 91 connecting the storage body 71 and the water supply source S (refer to FIG. 2) and a water supply valve 92 controlling opening and closing of the water supply pipe 91 according to a control signal of a controller (not shown).

A supply port (i.e., a second supply port) 75 connected to the storage unit 72 may be provided in the storage body 71, and the water supply pipe 91 may be provided as a hose connecting the second supply port 75 and the water supply source.

The first water supply unit 8 may include a mounting body 81 provided in the cabinet 1, a water supply pump 83 provided in the mounting body 81, a water supply tank 82 detachably coupled to the water supply pump 83 and storing water, and a connection pipe 85 connecting the water supply pump 83 and the storage unit 72.

As shown in FIG. 1, the mounting body 81 may include a first chamber 811 in which the water supply tank 82 is received and a second chamber 812 to which the water supply pump 83 is fixed. The first chamber 811 and the second chamber 812 may be distinguished from each other through a partition wall 813. The partition wall 813 is provided with a partition through-hole 814 connecting the two chambers, and the water supply pump 83 is connected to the partition through-hole 814 through a pump supply pipe 831.

The water supply tank 82 may be provided in any shape that is capable of storing water and attachable to and detachable from the first chamber 811, and FIG. 1 illustrates an example of a case that the water supply tank 82 is provided in a substantially hexahedral shape.

A tank supply port for supplying water into the water supply tank may be provided on one surface of the water supply tank 82, and the tank supply port may be provided to be opened and closed through a lid 822.

Water in the water supply tank 82 is discharged through a tank discharge port 821. The tank discharge port 821 should be provided to be connected to the partition through-hole 814 when the water supply tank 82 is inserted into the first chamber 811.

A check valve may be provided at the tank discharge port 821 so that water inside the water supply tank 82 may be discharged to the pump supply pipe 831 when the tank discharge port 821 is inserted into the partition through-hole 814, and an actuator 815 for opening the check valve may be provided in the partition through-hole 814.

A cover panel through-hole 181 may be provided in the cover panel 18 so that the water supply tank 82 may be withdrawn to the outside of the cabinet 1.

As shown in FIG. 7, water discharged from the water supply pump 83 is supplied to the steam generator 7 through the connection pipe 85. That is, the storage body 71 may be provided with a supply port (i.e., a first supply port) 74 connected to the storage unit 72, and the connection pipe 85 may be provided as a hose connecting a discharge port of the water supply pump 83 and the first supply port 74.

The steam generator 7 supplies steam into the drum 2 through a steam passage 76. The steam passage 76 may include a steam supply port 763 provided in the panel connection body 125, a steam discharge port 761 passing through the storage body 71 and connected to the storage unit 72, and a steam supply pipe 762 connecting the steam discharge port 761 and the steam supply port 763.

A water level inside the storage unit 72 may be measured through a water level sensor 79. The water level sensor 79 may include a multitude of conductors connected to a power source. FIG. 7 illustrates an example of a case that the water level sensor 79 includes a first conductor 791 extending from an upper surface of the storage unit 72 toward a bottom surface thereof and a second conductor 792 having a length different from that of the first conductor.

When water is supplied to the storage unit 72 and a free end of the first conductor 791 and a free end of the second conductor 792 are all submerged in the water, a circuit to which the two conductors 791 and 792 are connected is closed. The controller may sense that the current flows through the circuit having the two conductors, thereby recognizing that the water level in the storage unit 72 may be greater than or equal to a height of the free end of the second electrode 792.

When the heater 73 is operated, the steam generator 7 of the above structure may supply steam to the water supply pump 83 through the connection pipe 85 as well as to the inside of the drum 2 through the steam supply pipe 762. In order to prevent steam from being supplied to the water supply pump 83, the connection pipe 85 may be provided with a connection pipe valve 86. The connection pipe valve 86 may be provided to open/close the connection pipe 85 according to a control signal of the controller.

Figure 8:
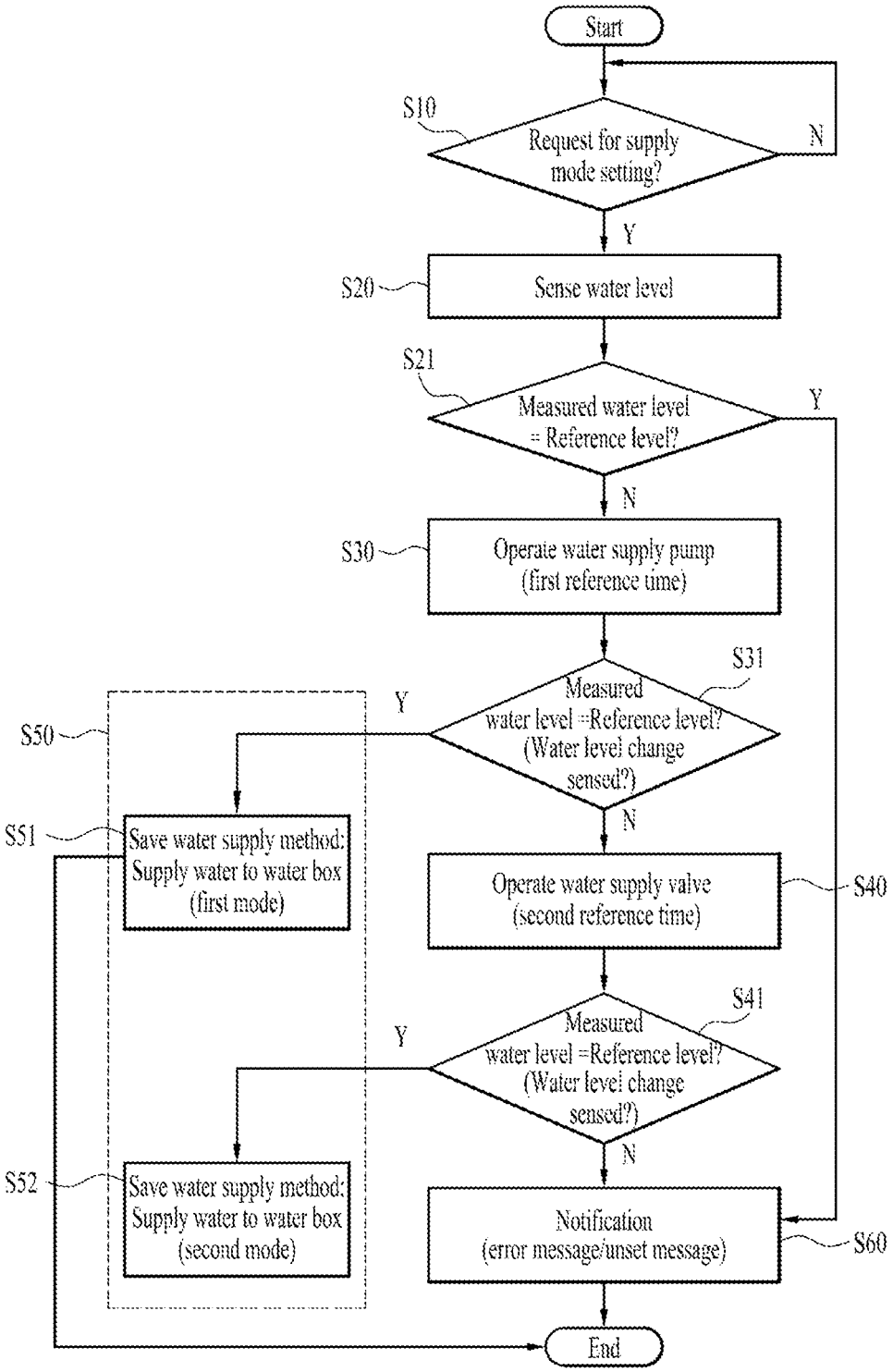
FIG. 8 illustrates an example of a method of controlling a laundry treating apparatus.

FIG. 8 illustrates an example of a method of controlling the above-configured laundry treating apparatus.

The control method of FIG. 8 includes a pump controlling step S30 of operating the water supply pump 83 and a water level sensing step (i.e., a first water level sensing step) S31 in which the water level sensor 79 senses a water level inside the steam generator 7 in the course of the pump controlling step.

The pump controlling step S30 proceeds until the water level in the steam generator 7 reaches a preset reference water level. The reference water level may be set as the highest level that can be sensed by the water level sensor 79.

Yet, it is preferable that an execution time of the pump controlling step S30 is terminated when a preset pump control reference time (i.e., a first reference time) elapses even if the water level in the steam generator 7 fails to reach the reference water level.

That is, the pump controlling step S30 operates the water supply pump 83 until the water level in the steam generator 7 reaches the reference water level, and the operation time of the water supply pump 83 is preferably set not to exceed the first reference time.

The first reference time may be set to a time when the water level inside the steam generator 7, which is empty during operation of the water supply pump 83, reaches the highest water level (i.e., the maximum water level that can be sensed by the water level sensor).

If the water level in the steam generator 7 fails to reach the reference water level during the pump controlling step S30 (e.g., if the water level in the steam generator is not changed), the control method proceeds to a valve controlling step S40 of opening the water supply pipe 91 by controlling the water supply valve 92 and a water level sensing step (i.e., a second water level sensing step) S41 of sensing the water level inside the steam generator 7 by the water level sensor 79 in the course of the valve controlling step S40.

The valve controlling step S40 is initiated when the operation of the water supply pump 83 is terminated, and may be performed until the water level in the steam generator 7 measured in the second water level sensing step S41 reaches the reference water level.

That is, the valve controlling step S40 operates the water supply valve 92 until the water level in the steam generator 7 reaches the reference water level, and the operation time of the water supply valve 92 is preferably provided not to exceed the valve control reference time (i.e., a second reference time).

The second reference time may be set to a time when the water level of the inside of the steam generator, which is empty when the water supply valve 92 is opened, is the highest water level that can be sensed by the water level sensor.

The control method executes a water supply mode setting step S50 according to whether the water levels in the steam generator 7 measured in the first water level sensing step S31 and the second water level sensing step S41 are changed.

The water supply mode setting step S50 is a step of determining whether the steam generator 7 is connected to the water supply tank 82 or the water supply source S.

That is, when it is determined that the water level in the steam generator is changed in the course of the operation of the pump controlling step S30 [S31], the water supply mode setting step sets a water supply by the water supply tank 82 to a default water supply mode [S51].

Yet, when it is determined that the water level in the steam generator 7 is changed in the course of the valve controlling step S40 [S41], the water supply mode setting step S50 sets the water supply mode by the water supply source S to a default water supply mode [S52].

The pump controlling step S30, the first water level sensing step S31, the valve controlling step S40, the second water level sensing step S41, and the water supply mode setting step S50 may be executed when receiving a request for setting a water supply mode from a user through a receiving step S10.

The receiving step S10 may be provided as a process in which an input unit provided in the control panel 115 receives a control command from a user.

Meanwhile, even if the request for setting the water supply mode is received from the user through the receiving step S10, if the steam generator 7 is filled up with water inside (i.e., the water level in the steam generator is the reference water level), the water level change in the steam generator cannot be detected through the first water level sensing step S31 and the second water level sensing step S41.

Therefore, it is preferable that the control method may be provided to execute an initial water level sensing step S20 of sensing the water level inside the steam generator 7 through the water level sensor 79 before the pump controlling step S30 is started after the completion of the receiving step S10.

When the water level in the steam generator measured in the initial water level sensing step S20 is less than the reference water level, the control method executes the pump controlling step S30, the first water level sensing step S31, the valve controlling step S40, the second water level sensing step S41, and the water supply mode setting step S50.

On the other hand, if it is determined that the water level in the steam generator measured in the initial water level sensing step S20 is equal to or greater than the reference water level, the control method executes a notifying step S60 of generating a signal (e.g., text or sound) indicating that the step of setting the water supply mode cannot be executed. The notifying step S60 may be executed through a display unit provided in the control panel 115.

Although the control method illustrated in FIG. includes a case in which the pump controlling step S30 is executed before the valve controlling step S40, the above-described control method may be configured such that the valve controlling step S40 is executed before the pump controlling step S30.

Since the above-described laundry treating apparatus may be modified in various forms, the scope of the present disclosure is not limited to the above-described embodiments.

What is claimed is:

1. A method of controlling a laundry treating apparatus having a laundry receiving unit providing a space for receiving laundry therein, a steam generator generating steam, a steam passage supplying the steam discharged from the steam generator to the laundry receiving unit, a water supply tank detachably coupled to a water supply pump, a connection pipe connecting the steam generator and the water supply pump, a water level sensor sensing a water level inside the steam generator, a water supply pipe connecting the steam generator and a water supply source, and a water supply valve opening/closing the water supply pipe, the method comprising:

a pump controlling step of operating the water supply pump;

a first water level sensing step of sensing the water level inside the steam generator by the water level sensor during the pump controlling step; and a water supply mode setting step of setting, based on the water level inside the steam generator being changed during the pump controlling step, a water supply operation through the water supply tank as a default water supply mode that is configured to be applied for subsequent water supply operations.

2. The method of claim 1, further comprising:

a valve controlling step of opening the water supply pipe by controlling the water supply valve based on the water level inside the steam generator not being changed during the pump controlling step; and a second water level sensing step of sensing the water level inside the steam generator by the water level sensor during the valve controlling step, wherein, based on the water level inside the steam generator being changed during the valve controlling step, the water supply mode setting step sets a water supply operation through the water supply source as the default water supply mode.

3. The method of claim 2, wherein the pump controlling step is terminated based on (i) the water level inside the steam generator reaching a preset reference water level or (ii) an operation time of the water supply pump reaching a preset first reference time.

4. The method of claim 3, wherein the preset first reference time is set based on a time interval during which the water level inside the steam generator changes, by operation of the water supply pump, from an empty state to a highest level detectable by the water level sensor.

5. The method of claim 3, wherein the valve controlling step is terminated based on (i) the water level inside the steam generator reaching the preset reference water level or (ii) an operation time of the water supply valve reaching a preset second reference time.

6. The method of claim 5, wherein the preset second reference time is set based on a time interval during which the water level inside the steam generator changes, by operation of the water supply valve, from an empty state to a highest level detectable by the water level sensor.

7. The method of claim 3, wherein the preset reference water level is set based on a highest level detectable by the water level sensor.

8. The method of claim 2, further comprising a receiving step of receiving a control command for requesting setting of a water supply mode through an input unit configured to receive an input of a control command from a user, wherein the pump controlling step, the first water level sensing step, the valve controlling step, the second water level sensing step, and the water supply mode setting step are executed after completion of the receiving step.

9. The method of claim 8, further comprising an initial water level sensing step of sensing the water level inside the steam generator by the water level sensor before initiation of the pump controlling step after completion of the receiving step, wherein the pump controlling step, the first water level sensing step, the valve controlling step, the second water level sensing step, and the water supply mode setting step are executed based on the water level measured in the initial water level sensing step being less than a reference water level.

10. A method of controlling a laundry treating apparatus having a laundry receiving unit providing a space for receiving laundry therein, a steam generator generating steam, a steam passage connecting the steam generator and the laundry receiving unit, a water supply pipe connecting the steam generator and a water supply source, a water supply valve opening and closing the water supply pipe, a water supply pump, a water supply tank storing water and detachably coupled to the water supply pump, a connection pipe connecting the steam generator and the water supply pump, and a water level sensor sensing a water level inside the steam generator, the method comprising:

a valve controlling step of operating the water supply valve for a preset valve control reference time; and a water supply mode setting step of setting, based on the water level inside the steam generator being changed during the valve controlling step, a water supply operation through the water supply source as a default water supply mode that is configured to be applied for subsequent water supply operations.

11. The method of claim 10, further comprising a pump controlling step of operating the water supply pump for a preset pump control reference time based on the water level inside the steam generator not being changed during the valve controlling step, wherein, based on the water level inside the steam generator being changed during the pump controlling step, the water supply mode setting step sets a water supply operation through the water supply tank as the default water supply mode.

* * * * *